United States Patent [19]

Iwasaki

[11] Patent Number: 4,461,264

[45] Date of Patent: Jul. 24, 1984

[54] IGNITION TRANSFORMER AND SPARK PLUG COVER ASSEMBLY

[75] Inventor: Shinichiro Iwasaki, Troy, Mich.

[73] Assignee: Aisin Seiki Kabushiki Kaisha, Kariya, Japan

[21] Appl. No.: 550,734

[22] Filed: Nov. 14, 1983

Related U.S. Application Data

[63] Continuation of Ser. No. 489,188, Apr. 27, 1983, abandoned, which is a continuation-in-part of Ser. No. 268,889, Jun. 1, 1981, Pat. No. 4,382,430, and Ser. No. 383,607, Jun. 1, 1982.

[51] Int. Cl.[3] ..... F02P 3/02

[52] U.S. Cl. ..... 123/635; 123/169 PA

[58] Field of Search ..... 123/634, 635, 643, 169 PA, 123/169 PB, 169 PH; 339/136 C, 143 S

[56] References Cited

U.S. PATENT DOCUMENTS

| | | | |
|---|---|---|---|
| 1,956,805 | 5/1934 | Meyer | 123/169 PH |
| 3,716,038 | 2/1973 | Bevacqua | 123/635 X |
| 3,792,694 | 2/1974 | Brenholts | 123/169 PH X |
| 4,300,519 | 11/1981 | Isogai et al. | 123/635 X |

*Primary Examiner*—Tony M. Argenbright

*Attorney, Agent, or Firm*—Oblon, Fisher, Spivak, McClelland & Maier

[57] ABSTRACT

An ignition transformer and spark plug cover assembly adapted for mounting on an internal combustion engine for application of ignition signals from an ignition circuit to a respective engine spark plug, including a base member fixedly fastened to the engine, including connector receptacles for making electrical connection thereto, a connector member mounted on the base member and having respective connectors contacts mating with the base member connector receptacles, a transformer assembly including an ignition transformer mechanically connected to and supported by the connector member and including connector pins for making electrical connection between the ignition transformer and the connector contacts of the connector member, and a cover for making electrical connection with a respective spark plug, including a high tension conductor connected to the ignition transformer.

10 Claims, 8 Drawing Figures

IGNITION TRANSFORMER AND SPARK PLUG COVER ASSEMBLY

CROSS-REFERENCE TO RELATED APPLICATIONS

This application is a continuation of application Ser. No. 489,188, filed Apr. 27, 1983, now abandoned, which is a continuation-in-part of U.S. application Ser. No. 268,889 filed June 1, 1981 now U.S. Pat. No. 4,382,430, and pending U.S. application Ser. No. 383,607 filed June 1, 1982, the disclosures of which are incorporated by reference herein.

BACKGROUND OF THE INVENTION

1. Field of the Invention

The present invention relates in general to automotive ignition systems, and more particularly to an ignition transformer and spark plug cover assembly for use in internal combustion engines.

2. Description of the Prior Art

Conventional ignition systems for internal combustion engines have proven themselves to be reliable and adequate for many years. In recent times these systems have been upgraded by means of various electronic switching apparata. However, even with the addition of electronic apparata, the systems remain very similar in operation to the conventional electromechanical systems. For example, current is introduced to an ignition transformer primary winding coil from a battery through a switch, such as a transistor. The energy of the ignition current supplied via the switch is accumulated as magnetic energy and discharged through a secondary (high voltage) winding coil across the electrodes of a spark plug.

Modern engines are required to meet a multitude of ever-tightening standards regarding the quantity and quality of exhaust emissions. In order to meet these requirements, engine manufacturers have resorted to producing engines which operate under very lean fuel-to-air mixtures and engines which employ stratified charge or turbulent flow technology. Lean burning engines require increased spark duration for proper operation. This is accomplished in the conventional systems by increasing the open circuit spark voltage. However, increasing the voltage results in an increase in the amplitude as well as the duration of the spark current which greatly decreases the life of the spark plugs. In turbulent flow-type systems, the flow of the charge within the individual cylinders of the engine tends to blow out or extinguish the spark plug arc prematurely thereby decreasing the duration of the spark which is detrimental to proper ignition.

Another problem inherent in conventional designs is that they generally use a common high-voltage generator in the form of a single ignition coil for all the spark plugs in the engine. The high voltage from the single coil is then distributed to the various plugs by means of a rotary high voltage switch or distributer and a system of high voltage cables. The distribution and high voltage cables are well-known to be frequent sources of problems and thus are the weak links in the conventional system.

SUMMARY OF THE INVENTION

Accordingly, one object of this invention is to provide a novel AC ignition system wherein the duration of ignition can be increased over that of a conventional system without decreasing the life of the spark plugs.

Another object of the present invention is to provide a novel AC ignition system which eliminates the need for a high voltage distribution system.

Still another object is to provide a novel ignition system wherein a separate high voltage generator is provided for each spark plug in the engine.

Yet another objective is to provide a novel ignition transformer and spark plug cover assembly capable of being securely mounted on an engine head immediately adjacent a respective spark plug.

Another object of this invention is to provide an ignition system employing a novel transformer and spark plug cover assembly of the above-noted type whereby it is possible to reduce the size of the ignition coil and yet maintain adequate energy discharge across the spark plug electrodes.

Yet another object is to provide a novel AC ignition system which produces an alternating current and therefore an intermittent spark within the spark plug. In such an AC system, the duration of the ignition can be greatly increased over that of the conventional systems without a corresponding decrease in spark plug life. Also, since the total ignition comprises a plurality of short intermittent sparks, the blow-out problems of turbulent flow engines are greatly reduced.

Still a further object of this invention is to provide a novel ignition system which overcomes the difficulties inherent in the conventional systems utilizing a common high voltage generator by providing an essentially independent high voltage generator system for each spark plug in the engine.

These and other objects are achieved or facilitated in accordance with the invention by providing a new and improved ignition transformer and spark plug cover for an internal combustion engine, wherein separate ignition transformers are mounted in a respective such assembly and each assembly is mounted on an engine head immediately adjacent a respective spark plug and electrically connected thereto. This eliminates most of the high voltage wiring, as well as the distributor of the conventional ignition system.

In a preferred embodiment, the assembly of the invention includes a mounting base member adapted to be fixedly fastened to the engine head, wherein the base member includes connector receptacles for making electrical connection thereto, a connector member mounted on said base member and having connector contacts mating with respective receptacles of the base member, a transformer assembly including an ignition transformer mechanically connected to and supported by the connector member, and a cover member adapted for making electrical connection to a respective spark plug, wherein the cover member is electrically connected to the ignition transformer by means of a short length high tension conductor supported by the transformer assembly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
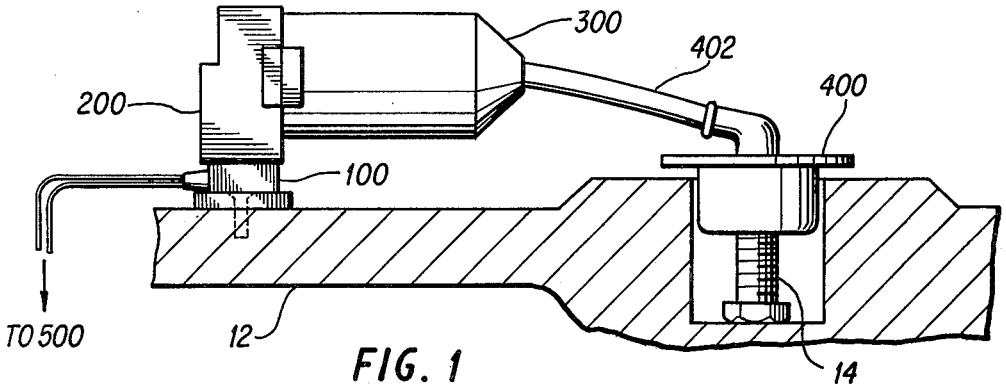
FIG. 1 is a side view of the ignition transformer and spark plug cover assembly of the invention adapted for mounting on an engine block.

Referring now to the drawings, wherein like reference numerals designate identical or corresponding parts throughout the several views, and more particularly to FIG. 1 thereof, in FIG. 1 the assembly 10 of the invention is shown as including a base member 100 securely fastened to an engine block 12, a connector member 200 mounted on the base member 100, a transformer assembly 300 mounted on the connector assembly 200, and a cover 400, including a high tension conductor 402 for making connection to the transformer assembly 300 and a cover member 404 shown making an electrical connection to a conventional spark plug 14 by means of a connector member (not shown) making electrical connection to a terminal (not shown) of the spark plug 14.

Figure 2:
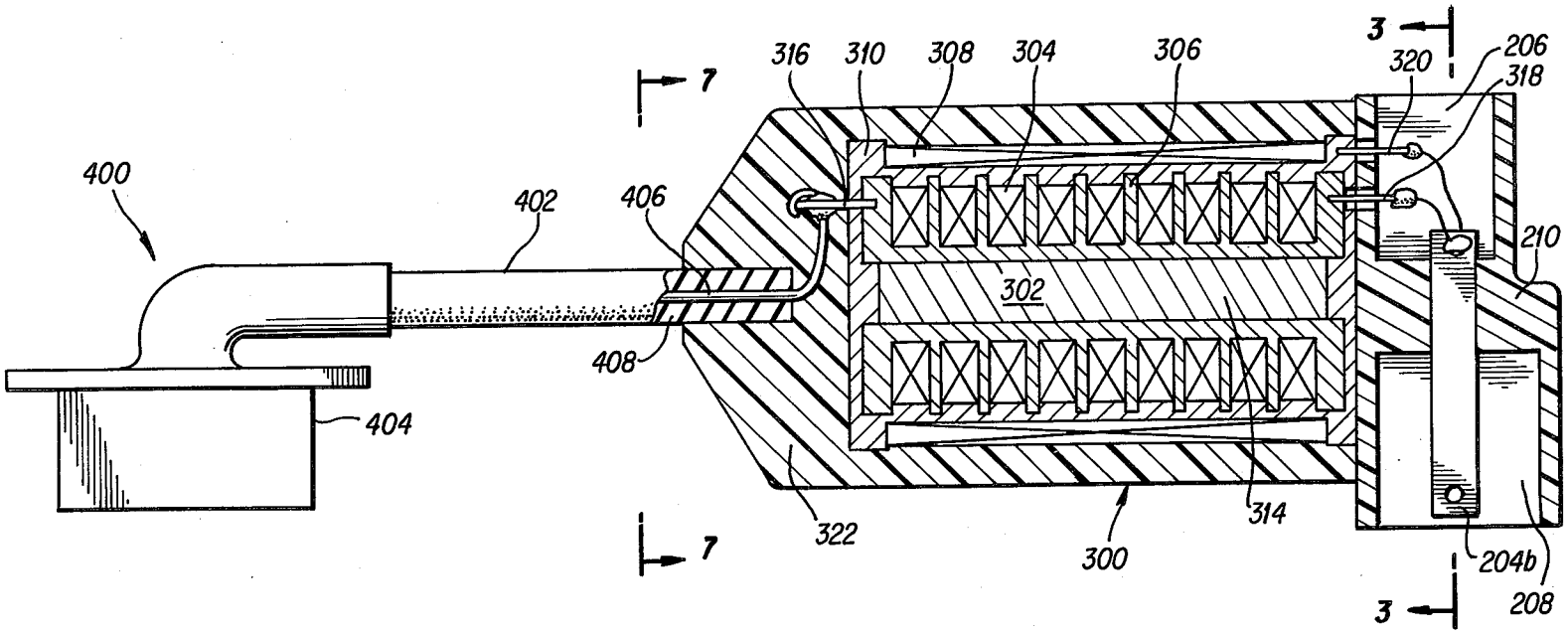
FIG. 2 is a cross-sectional view taken along lines 2—2 shown in FIG. 3 of the assembly according to the invention.

In FIG. 2, the assembly of the invention is shown in more detail. The high tension conductor 402 is shown as including an inner conductor 406 surrounded by an insulating layer 408. Conductor 402 is of conventional design.

Transformer assembly 300 includes an ignition transformer 302 including a secondary winding 304 mounted on a first bobbin 306 and a primary winding 308 mounted on a second bobbin 310. The secondary winding 304 as shown in FIG. 2 is implemented in nine series connected sections. Bobbins 306 includes a central bore 312 in which is disposed a core 314. Electrical connection is made to the secondary winding 304 on one side thereof to the conductor 406 by means of pin 316. The other side of secondary winding 304 is electrically connected to a contact 204 of connector member 200 by means of pin 318.

Fabrication of transformer assembly 300 begins with molding of the bobbin 306 of a thermoplastic material such as epoxy resin, polytetrafluoroethylene (TEFLON ®), etc. Pins 316, 318 are integrally molded into the bobbin 306. Secondary winding 304 is then wound in plural sections on the bobbin 306 and spot welded to the pins 316, 318. Core 314 is then inserted in the bore of the bobbin 306. Thereafter, the second bobbin 310 is integrally molded around the first bobbin 306 and core 314, with a pair of pins 319, 320 formed therein for making spot welded electrical connection to the primary winding 308 which is subsequently wound around the bobbin 310. Thereafter, the conductor 406 of the high tension wire 402 is interconnected to the pin 316 and a plastic case 322 is molded around the ignition transformer 302.

Figure 3:
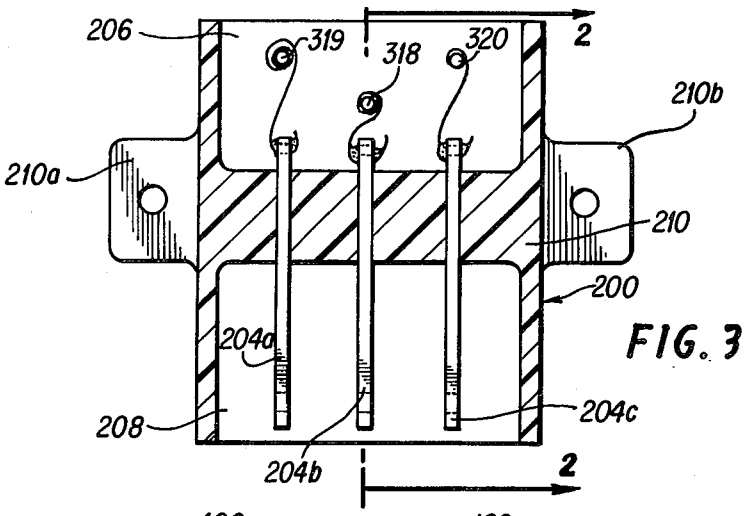
FIG. 3 is a cross-sectional view taken along the lines 3—3 shown in FIG. 2 of the connector member of the assembly according to the invention.

FIGS. 2 and 3 show the structure of the connecting member 200 and the interconnection thereof with the transformer assembly 300 as above described. Connector member 200 includes a molded plastic housing 202 defining hollow cavities 206, 208 separated by a midsection 210. Integrally molded within the midsection 210 and supported thereby are three contact members **204*a*, 204*b*, and 204*c*. Contact 204*a* is connected to pin 319 connected to one side of the primary winding 308 of the ignition transformer 302 and contact 204*c* is connected to pin 320 connected to the opposite side of the primary winding 308. Contact 318 is connected to one side of the secondary winding via pin 318. Although FIG. 3 indicates that pins 318, 319 and 320 are connected respectively to contacts 204*a*, 204*b* and 204*c*** by means of a solder joint, it should be understood that this interconnection can otherwise be made by means of conventional male/female pin engagement.

Figure 7:
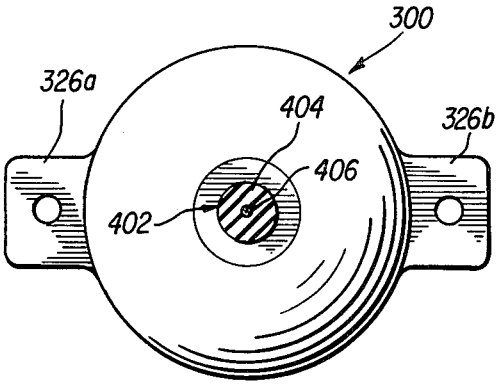
FIG. 7 is a cross-sectional view taken along lines 7—7 shown in FIG. 2 of the assembly according to the invention.

As is evident from FIGS. 3 and 7, transformer assembly 300 and connector member 200 are each provided with opposed flange members **326*a*, 326*b* and 210*a*, 210*b*, respectively, by which transformer assembly 300 and connector member 200 are mechanically interconnected. This interconnection may be made by providing a selected of the flanges of the transformer assembly 300 or the connecting member 200** with a threaded hole and the other flanges thereof with a mating opposing hole and screwing the respective opposed flanges together. Otherwise, opposed holes can be drilled through the opposed flanges and the flanges interconnected by means of a nut, bolt and lock washer assembly, not shown.

Figure 6:
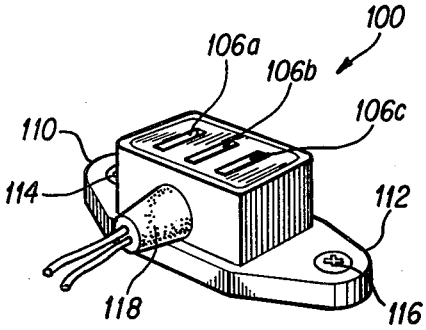
FIG. 6 is a perspective view of the base member of the assembly according to the invention.
Figure 8:
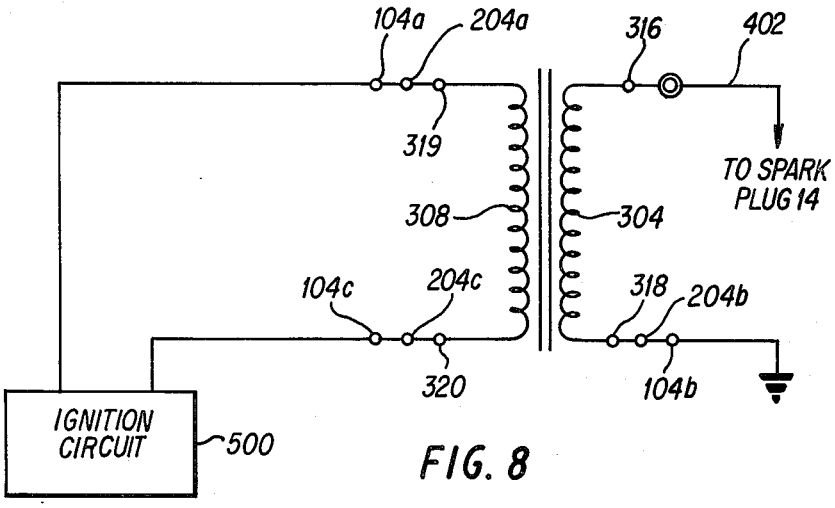
FIG. 8 is a circuit diagram illustrating the electrical connections implemented by means of the assembly according to the invention.
Figure 4:
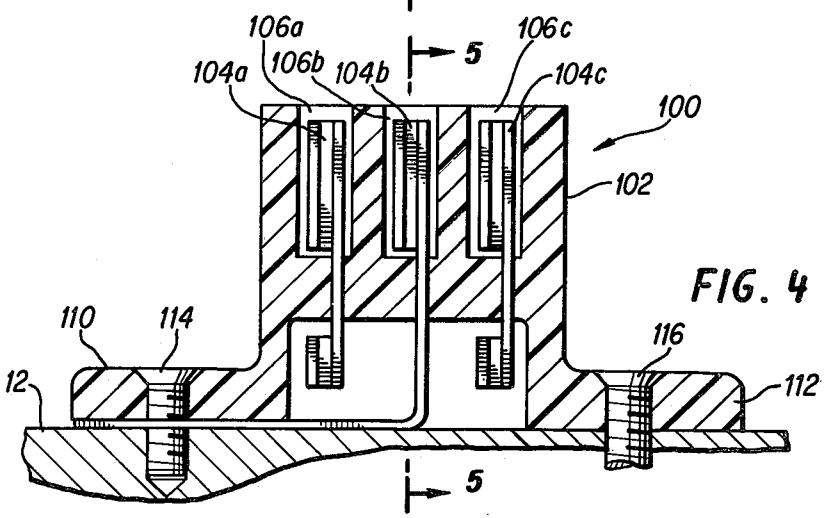
FIG. 4 is a cross-sectional view taken along the lines 4—4 shown in FIG. 5 of the base member of the assembly according to the invention.
Figure 5:
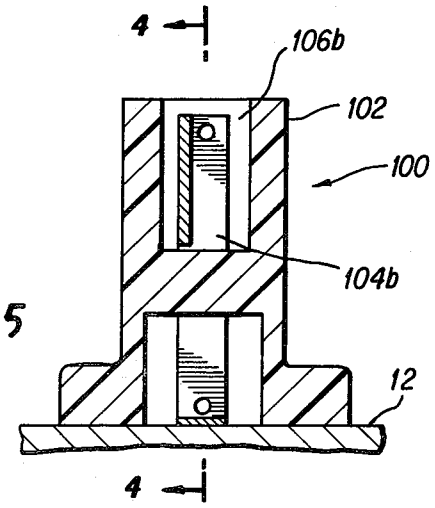
FIG. 5 is a cross-sectional view taken along the lines 5—5 shown in FIG. 4 of the base member of the assembly according to the invention.

FIGS. 4, 5 and 6 illustrate the base member 100 of the present invention. Base member 100 is formed of an integrally molded housing 102 having receptacle members **104*a*, 104*b* and 104*c* provide for mating engagement with contacts 204*a*, 204*b* and 204*c*, respectively. The housing 102 defines three hollow cavities 106*a*, 106*b* and 106*c* in which respective ends of the receptacles 104*a*, 104*b* and 104*c* protrude, and wherein mating engagement of the male contacts 204*a*, 204*b* and 204*c* with one end of a respective female receptacle 104*a*, 104*b* and 104*c* is accomplished. The other ends of receptacles 104*a* and 104*c* are connected to an ignition circuit 500 as shown in FIG. 8, while the other end of receptacle 104*b* is grounded to the engine body 12** as shown in FIGS. 4 and 5.

The ignition circuit 500 may be any of the ignition circuits shown in the above-noted cross-references applications Ser. Nos. 268,889 and 383,604. The connections from the ignition circuit 500 to the base member receptacles **104*a* and 104*c*** need not be made by a high tension connection, according to the invention, since the signals on these wires are relatively low voltage and low current.

As is also shown in FIGS. 4 and 6, the base member 100 is fastened to the engine block by means of flange members 110, 112, each having holes formed therein by which the flange members 110 and 112, as well as the base member 100, can be screw fastened to the engine body by means of screws 114, 116. Optionally, a rubber boot can be provided surrounding the flange members 110, 112 and the lower portion of the base member 100 as shown in FIG. 4. As shown in FIG. 6, a protective covering 118 may be provided to protect the interconnection between the conductors from the ignition circuit 500 to the receptacles 104*a*, 104*c*.

The above-described ignition transformer and spark plug cover assembly is particulary advantageous in providing a secure mechanical mounting of an ignition transformer in immediate proximity to a respective spark plug, whereby the ignition transformer is relatively uninfluenced by engine temperature. Furthermore, in view of the secure mounting provided by the several screw fastenings of the invention, the above-disclosed assembly is unaffected by engine vibration. Further, by providing an assembly which can be mounted in immediate proximity to a respective spark plug it is possible to employ relatively long length low tension conductors for interconnecting the ignition circuit with each transformer, while employing only relatively short length high tension conductors for application of the ignition voltage and current to the spark plug.

Obviously, numerous modifications and variations of the present invention are possible in light of the above teachings. For example, the mounting and connection teachings of the invention can readly be adapted to replace the transformer 302 above-described with the ignition transformers disclosed in my above cross-referenced related applications. It is therefore to be understood that within the scope of the appended claims, the invention may be practiced otherwise than as specifically described herein.

What is claimed as new and desired to be secured by Letters Patent of the United States is:

1. An ignition transformer and spark plug cover assembly adapted for mounting on an internal combustion engine for application of ignition signals from an ignition circuit to a respective engine spark plug, comprising:

connector means adapted to be electrically connected to said ignition circuit by means of low tension conductors and fixedly fastened to said engine in close proximity to said respective spark plug;

a transformer assembly, including an ignition transformer, mechanically connected to and supported by the connector means; and a cover member adapted for making electrical connection with a respective spark plug, comprising a high tension conductor connected to the ignition transformer.

2. An ignition transformer and spark plug assembly according to claim 1, wherein said connector means comprises:

a base member adapted to be fixedly fastened to the engine, including connector receptacles for making electrical connection thereto, and a connector member mounted on said base member and having respective connectors contacts mating with the base member connector receptacles.

3. An ignition transformer and spark plug cover assembly according to claim 2, wherein said transformer assembly comprises:

contact means for making electrical connection between said ignition transformer and said connector contacts of said connector member.

4. An ignition transformer and cover assembly according to claim 3, wherein said transformer assembly comprises:

a first bobbin having a secondary winding wound thereon and having a central bore in which a core member is disposed;

a second bobbin molded onto said first bobbin and said secondary winding, said second bobbin having a primary winding wound thereon;

connector pins integrally molded in said first and second bobbins for making electrical connection to said secondary and primary windings; and an insulating casing molded in surrounding relation to said first and second bobbins.

5. An ignition transformer and cover assembly according to claim 4, wherein said connector member comprises:

a housing having upper and lower hollow cavities separated by a central section;

plural contacts embedded in said central section and extending into said upper and lower hollow cavities;

wherein the extensions of said contacts into said upper hollow cavity are connected to the primary and secondary windings in said transformer assembly.

6. An ignition transformer and cover assembly according to claim 5, wherein said base member comprises:

an insulating housing having embedded therein plural connector receptacles, one for each of said contacts of said connector member, wherein one of said receptacles is adapted to be grounded to the engine.

7. An ignition transformer and cover assembly according to claim 1, wherein said transformer assembly comprises:

an insulating casing surrounding said ignition transformer.

8. An ignition transformer and cover assembly according to claim 1, wherein said transformer assembly comprises:

a first bobbin having a secondary winding wound thereon and having a central bore in which a core member is disposed; and a second bobbin surrounding said first bobbin and said secondary winding, said second bobbin having a primary winding wound thereon.

9. An ignition transformer and cover assembly according to claim 8, wherein said first bobbin comprises:

plural series connected sections in which said secondary winding is wound.

10. A method of fabricating an ignition transformer and spark plug cover assembly adapted for mounting on an internal combustion engine for application of ignition signals from an ignition circuit to a respective engine spark plug, wherein the ignition transformer and spark plug cover assembly is formed at least of connector means adapted to be electrically connected to the ignition circuit by means of low tension conductors and fixedly fastened to said engine in close proximity to said respective spark plug, a transformer assembly mechanically connected to an supported by the connector means and including an ignition transformer and an insulating casing surrounding the ignition transformer, and a cover member adapted for making electrically connection with said respective spark plug, including a high tension conductor connected to the ignition transformer, and wherein the transformer assembly further includes a first bobbin having a secondary winding wound thereon and having a central bore in which a core member is disposed, and a second bobbin surrounding said first bobbin and said secondary winding, said second bobbin having a primary winding wound thereon, comprising the following steps:

molding of said first bobbin;

winding of said secondary winding onto said first bobbin;

inserting said core into said bore;

molding of said second bobbin onto said first bobbin;

winding of said primary winding onto said second bobbin; and molding of said insulating casing in surrounding relation to said first and second bobbins.

* * * * *

UNITED STATES PATENT AND TRADEMARK OFFICE

CERTIFICATE OF CORRECTION

PATENT NO. : 4,461,264

DATED : JULY 24, 1984

INVENTOR(S) : SHINICHIRO IWASAKI

It is certified that error appears in the above-identified patent and that said Letters Patent is hereby corrected as shown below:

Column 4, line 31, delete "selected" and insert therefor --selection--;

Column 4, line 42, delete "provide" and insert therefor --provided--;

Column 5, line 7, delete "particulary" and insert therefor --particularly--;

Column 5, line 26, delete "readly" and insert therefor --readily--;

Column 5, line 27, delete "my" and insert therefor --the--;

Column 6, line 60, delete "an" and insert therefor --and--;

Column 6, line 63, delete "electrically" and insert therefor --electrical--.

Signed and Sealed this

*Eighteenth* Day of *December 1984*

[SEAL]

*Attest:*

*Attesting Officer*

GERALD J. MOSSINGHOFF

*Commissioner of Patents and Trademarks*